US005134979A

United States Patent [19]

Pfalzgraf

[11] Patent Number: 5,134,979

[45] Date of Patent: Aug. 4, 1992

[54] LOAD ADJUSTMENT DEVICE

[75] Inventor: Manfred Pfalzgraf, Frankfurt am Main, Fed. Rep. of Germany

[73] Assignee: VDO Adolf Schindling AG, Frankfurt am Main, Fed. Rep. of Germany

[21] Appl. No.: 580,630

[22] Filed: Sep. 10, 1990

[30] Foreign Application Priority Data

Oct. 6, 1989 [DE] Fed. Rep. of Germany ..... 3933446

[51] Int. Cl.[5] ..... F02D 11/10

[52] U.S. Cl. ..... 123/399; 123/400

[58] Field of Search ..... 123/399, 396, 361, 400

[56] References Cited

U.S. PATENT DOCUMENTS

| | | | |
|---|---|---|---|
| 2,476,652 | 7/1949 | Black | 123/361 |
| 4,424,785 | 1/1984 | Ishida et al. | 123/399 |
| 4,523,565 | 6/1985 | Omitsu | 123/399 |
| 5,027,766 | 7/1991 | Zentgraf et al. | 123/399 |

FOREIGN PATENT DOCUMENTS

| | | |
|---|---|---|
| 0121939 | 10/1984 | European Pat. Off. . |
| 0295414 | 12/1988 | European Pat. Off. . |
| 3815734 | 2/1989 | Fed. Rep. of Germany . |
| 2144179 | 2/1985 | United Kingdom . |

OTHER PUBLICATIONS

Patent Abstracts of Japan, vol. 9, No. 3, (M-349) [1726], Jan. 9, 1985; & JP-A-59 153945, Sep. 1, 1984.

*Primary Examiner*—Andrew M. Dolinar
*Attorney, Agent, or Firm*—Martin A. Farber

[57] ABSTRACT

A load adjustment device having a control element (11) which can act on a setting member (12), determines the output of an internal combustion engine, and cooperates with a driver (3) which is coupled to an accelerator pedal (1). In addition, the driver can be moved by an electric setting drive (15), having a desired-value detection element (7) associated with the driver and an actual-value detection element (13) which cooperates with said desired-value detection element and acts on the electric setting drive. The electric setting drive is adapted for control by an electronic control device (14) as a function of the values detected. In order to assure a movement of the control element which is free of reaction on the driver upon control of the electric setting drive, a switch clutch (10) is provided in accordance with the invention between driver and control element.

7 Claims, 2 Drawing Sheets

LOAD ADJUSTMENT DEVICE

FIELD AND BACKGROUND OF THE INVENTION

The present invention relates to a load adjustment device having a control element for acting on a setting member which determines the output of an internal combustion engine. The control element cooperates with a driver which is coupled to an accelerator pedal and, in addition, can be moved by means of an electric setting drive. There is a desired-value detection element associated with the driver, and an actual-value detection element cooperating with the driver and acting on the electric setting drive. The electric setting drive is controllable by an electronic control device as a function of the values detected.

A load adjustment device of this type is known from Federal Republic of Germany patent document 38 15 734 A1. In it the driver and the control element are coupled by means of a coupling spring and the control element is urged in the direction of a stop on the driver. The position of the driver is indicated by the desired-value detection element, and the position of the control element by the actual-value detection element. The values detected by the two elements are forwarded to an electronic control device which controls the control element cooperating with the setting member via an electric setting drive in accordance with a control characteristic predetermined between the two elements. The coupling spring in this connection makes certain that, upon divergent movements of driver and control elements, a failure of the electronic control device always leads to a change in the setting of the load to a value of the output which corresponds to the value of the accelerator pedal.

Said load adjustment device has, in principle, proven itself in practice. Nevertheless, there are conceivable in connection with it operating conditions in which, with the electric setting drive activated, the control element must also move the driver, and this even against the restoring forces acting on the driver. This requires a stronger development of the setting drive and of an electromagnetic switch clutch arranged, for instance, behind said drive. Furthermore, a reaction-free operation of the control element and thus of the setting element is not assured in all operating conditions of the load adjusting device.

SUMMARY OF THE INVENTION

It is an object of the present invention to develop a load adjustment device of the type indicated such that, upon control of the electric setting drive, a movement of the control element which is without reaction with respect to the driver is assured.

According to the invention, a switch clutch (10) is arranged between driver (3) and control element (11). The switch clutch permits separation of the desired-value side and the actual-value side of the load adjustment device so that the desired-value side, i.e. the control element and the setting member, can be moved without reaction with respect to the driver. Forces acting on the driver, and particularly restoring spring forces, need therefore no longer be overcome by the electric setting drive. In actual practice, to be sure, it will also be necessary to provide a restoring spring for moving the control element into an idling position, but this spring can be made substantially weaker than a restoring spring which acts on the driver and which, furthermore, must urge the accelerator pedal and the mechanical parts arranged between the latter and the driver into their idle positions.

In accordance with a preferred embodiment of the invention, the switch clutch is developed as an electromagnetic switch clutch (10) which is opened upon an activating of the electric setting drive. In this way, for example, in emergency-travel operation, i.e. upon a failure of the electric setting drive, the controlling of the setting member takes place exclusively on the accelerator-pedal side, while, upon activation of the electric-setting drive, the accelerator-pedal side is completely separated from the control element and thus from the setting member. The switch clutch is advisedly furthermore developed as a codable switch clutch (10). By this there is understood a switch clutch which, to be sure, closes when the electric setting drive is without voltage but connects the driver and the control element in force-locked manner to each other only in a specific position.

With linear relative movement of driver and control element, the switch clutch can be connected for this purpose, for instance, with an extension in the region of one clutch half and with a recess in the region of the other clutch half, the extension and recess engaging only in the said specific relative position of the clutch halves. The same is true upon a turning of driver and control element with respect to each other. The purpose of the codable switch clutch is to make certain that the transmission of force from driver and control element, and thus action on the setting member, takes place only in operation-compatible positions, i.e. positions of driver and control element which represent the same travel conditions.

Thus, it is conceivable, for instance, for the setting member and thus also the control element to be in a full-load position in the case of a speed-limiting control while the desired value which is established by the accelerator pedal corresponds to an idle position. If the electric setting drive were to become without current in this condition of travel and the switch clutch close, positions of driver and control element which are not correlated with each other would result.

The codable switch clutch in this case, to be sure, permits a connecting of driver and control element, but without force lock, which takes place only in the case of positions of driver and control element which correlate to each other. A preferred position is established in this connection when both the driver and the control element have reached their idle positions. In order to effect the transfer of the control element into the idle position, it is necessary that said element be urged into idle position by means of a separate return spring.

In this connection, one particular embodiment of the invention provides that the driver (3) have a free-travel element (9) with which the driver side (**3*b*, 10*a*) of the switch clutch (10) cooperates, and that the driver (3) and the control element (11) are urged in idle direction by means of the restoring springs (5, 17). Furthermore, the control element (11) is urged into an idle emergency operation position by an idle emergency operation spring (18**) which acts in full-load direction. In this case, no rigid coupling is brought about between driver and control element but rather the driver side of the switch clutch is moveable relative to the free-travel element within the predetermined dimensions of the latter in order in this way, corresponding to the pre-established direction of action of the idle emergency spring which advisedly acts against a stop, to assure the reaction-free arrangement of control element and driver.

In order to be able to keep the spring forces acting on the control element as small as possible, the electric setting drive (15) cooperates directly via a switch clutch, particularly an electromagnetic switch clutch (16), with the control element (11). In particular, the restoring spring which is associated with the control element need not, after the disconnecting of the electric setting drive, move the control element into the idling position against the force of the setting drive, it being rather sufficient to disconnect the electric setting drive and the control element via the electromagnetic switch clutch.

Finally, at least one safety contact (8, 20) is advisedly associated with the driver (3) and control element (11) in order to monitor specific operating position of driver and control element respectively.

In this connection, the driver-side safety contact (8) advisedly monitors the idle position of the driver (3) and the control-element-side safety contact (20) monitors the idle emergency position of the control element (11).

One basic embodiment of the invention is shown with two different clutch variants in the figures, without the invention being limited to them.

BRIEF DESCRIPTION OF THE DRAWING

With the above and other objects and advantages in view, the present invention will become more clearly understood in connection with the detailed description of a preferred embodiment when considered with the accompanying drawing, of which.

DETAILED DESCRIPTION OF THE PREFERRED EMBODIMENTS

The operation of the load adjustment device of the invention is based essentially on the load adjustment device described in Federal Republic of Germany patent document 38 15 734 A1 so that, to this extent, reference is had to the specification contained therein.

Figure 1:
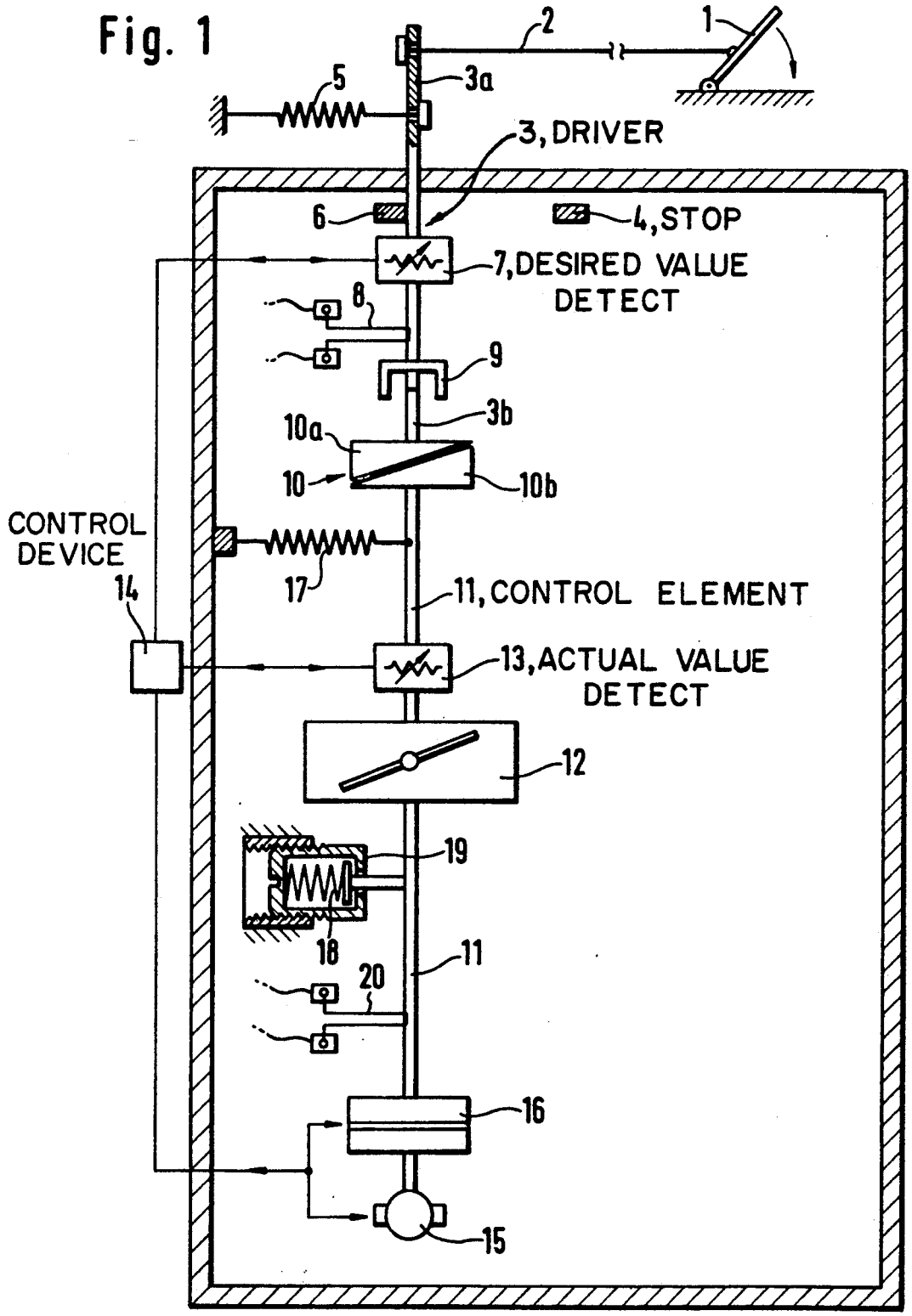
FIG. 1 is a block diagram showing the basic principle of the load adjustment device of the invention.

FIG. 1 shows an accelerator pedal 1 to which there is connected a rod or Bowden cable 2 which acts on a driver part 3 of a bipartite driver. By means of the accelerator pedal 1 there is the possibility, via the rod or Bowden cable 2, of moving the driver part 3*a* in full-load direction until it comes against the full-load stop 4, a restoring spring 5 thus urging the driver part 3*a* against an idle stop 6. The driver part 3*a* is connected to a desired value detection element 7 which operates in the manner of a wiper of a potentiometer which detects the driver position. Finally, a safety contact 8 cooperates with the driver part 3*a*, the contact 8 being activated when the driver part 3*a* rests against the idle stop 6.

The driver part 3*a* finally has a free-travel element developed as free-travel hook 9 with which the second driver part 3*b* of the driver 3 cooperates. This driver part 3*b* is connected to a clutch-half 10*a* of an electromagnetically acting codable switch clutch 10. To the other clutch-half 10*b* of the switch clutch 10 there is connected a control element 11 which serves for the direct displacement of a setting member in the form of a throttle valve 12 or fuel injection. The position of the control element 11 is represented by means of an actual-value detection element 13 which is developed, corresponding to the desired-value detection element 7, in the manner of a potentiometer with wiper.

An electronic control device 14 cooperates with the desired-value detection element 7 and the actual-value detection element 13, and controls inter alia an electric setting motor 15 and an electromagnetic switch clutch 16. The electric motor 15 is adapted to be brought into operative connection with the control element 11 via the electromagnetic switch clutch 16. A restoring spring 17 acts on the control element 11 and furthermore an idle emergency spring 18 urges the control element in full-load direction against an adjustable stop 19 in the idle emergency position. The idle emergency position of the control element 11 is monitored by a safety contact 20 which cooperates with it.

The load adjustment device which has been described above permits control of the throttle valve 12 directly from the accelerator-pedal side via the driver 3. Furthermore, upon a disconnecting of the driver 3 and activation of the electric setting drive 15, the adjustment device permits simultaneous switching of the electromagnetic switch clutch 16 directly via the control element 11. Thus the throttle valve 12 is controlled in ordinary travel via the accelerator pedal 1 and the driver 3, with codable switch clutch 10 closed and electromagnetic switch clutch 16 open, and the electric setting motor 15 possibly at the same time disconnected. The accelerator pedal 1 thus acts, via the first driver part 3*a* and the free-travel hook 9 associated with it, on the second driver part 3*b* and in force-locked manner via the switch clutch 10 on the control element 11, which displaces the throttle valve 12.

Upon a movement of the first driver part 3*a* in full-load direction, the second driver part 3*b* thereby comes against an arm of the free-travel hook 9 which extends into the path of movement of said driver part and is carried along in full-load direction. Upon a movement in idling direction beyond the idle emergency position, the other arm of the free-wheel hook 9 comes against the second driver part 3*b*. Under given conditions of travel, for instance idle regulation of the internal combustion engine, anti-slip control, or speed-limiting control, the electric setting motor 15 is activated and the electromagnetic switch clutch 16 closed, with simultaneous opening of the codable switch clutch 10.

The driver 3 is thus completely separated from the control element 11 so that now the controlling of the throttle valve 12 takes place exclusively via the electric setting motor 15. On the latter there now act as spring elements only the return spring 17 and, in the region from minimal idle position up to idle emergency position, the idle emergency spring 18, which latter spring, in order to be able to exercise its function, must have a greater pressing force than the pulling force of the restoring spring 17.

In order, after control by electric motor of the control element 11, to assure a well-defined association of driver 3 with control element 11, the clutch halves 10*a* and 10*b* of the codable switch clutch 10 have detent elements which become active, inter-engaging with each other, only when the desired-value position of the driver 3 agrees with the actual-value position of the control element 11 and, in particular, when both the driver 3 and control element 11 are in idle position.

Figure 2:
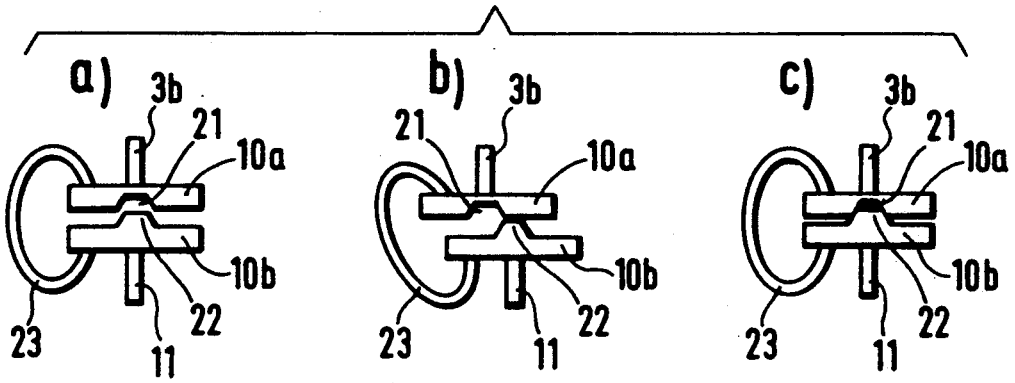
FIGS. 2(*a*)–2(*c*) are diagrammatic showing of the manner of action of the codable switch clutch upon a linear movement of driver and control element.

FIG. 2 shows the two clutch halves 10*a* and 10*b* for a linear movement of the second driver part 3*b* and of the control element 11, the driver-side clutch half 10*a* being provided with a central depression 21, while the control-element side clutch half 10*a* is provided with a central elevation 22, developed in a manner corresponding to the depression. The closing force of a spring 23 acts on both clutch halves 10*a* and 10*b*. The one clutch half 10*a* is developed, for instance, as electromagnet, while the other clutch half 10*b* is developed as permanent magnet. When current flows through the electromagnetic switch clutch 10, the two clutch halves 10*a* and 10*b* are pressed apart while when no current is present in the switch clutch 10, they rest against each other.

In the case wherein the clutch halves rest against each other, as can be noted from part (b) of FIG. 2, with noncorrelated positions of the second driver part 3*b* and control element 11, no form-locked connection is possible between the elevation 22 and the depression 21 since these parts of the clutch halves 10*a* and 10*b* are shifted with respect to each other. Only when the positions of the two clutch halves 10*a* and 10*b* correlate as shown in part (a) of FIG. 2, can the spring 23 move the two clutch halves 10*a* and 10*b* into their positions lying completely against each other. In these positions, as shown in part (c) in FIG. 2, the elevation 22 of the clutch half 10*b* enters into the depression 21 of the clutch half 10*a*.

Figure 3:
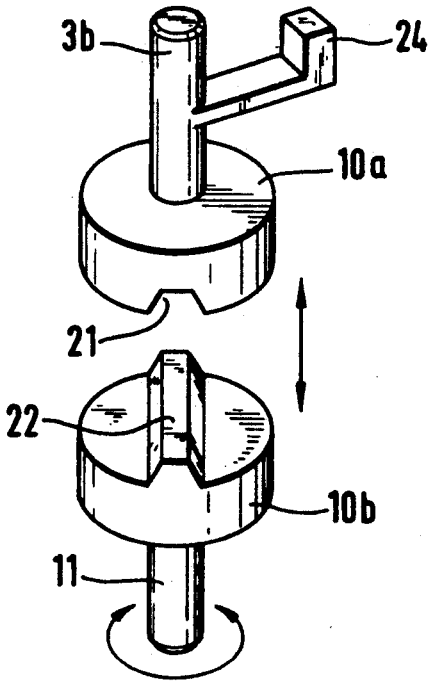
FIG. 3 is a showing of the clutch corresponding to FIG. 2 for a rotary movement between driver and control element.

In the event that the driver 3 and the control element 11 effect a rotary movement with respect to each other, a development of the codable switch clutch 10 such as shown in FIG. 3 is suitable. This figure shows only the basic construction of the electromagnetic clutch 10, without the spring element 23 which urges the clutch halves 10*a* and 10*b* towards each other against the magnetic force. Thus the rotary movement is introduced into the driver-side clutch half 10*a* via a lever extension 24 which is directly or indirectly connected with the rod 2, while the clutch half 10*b* is directly connected via the control element 11 to the throttle valve 12. The clutch half 10*a* is provided with a corresponding depression 21 and the other clutch half 10*b* with an elevation 22. FIG. 3 shows that the two clutch halves 10*a* and 10*b* can be connected in form-locked manner with each other via depression 21 and elevation 22 only in the position of the clutch halves shown in this figure.

I claim:

1. A load adjustment device comprising:

an accelerator pedal, a setting member which determines the output of an internal combustion engine, and a control element for acting on the setting member;

an electric setting drive, and a driver which is coupled to the accelerator pedal, the control element being moveable by means of the electric setting drive;

a desired-value detection element for detecting a position of the driver, and an actual-value detection element for detecting a position of the control element;

an electronic control device controlling the electric setting drive as a function of values detected by the desired and the actual value detection elements;

a switch clutch arranged between the driver and the control element for coupling the control element to the driver; and a free-travel element disposed at and cooperating with the driver side of the switch clutch.

2. A load adjustment device according to claim 1, further comprising a second switch clutch which is closed upon deactivation and operates in conjunction with the setting drive; and wherein the first-mentioned switch clutch is formed as an electromagnetic switch clutch which is opened upon an activating of the electric setting drive or upon a closure of the second switch clutch.

3. A load adjustment device according to claim 1, wherein the switch clutch is developed as a codable switch clutch.

4. A load adjustment device according to claim 1, further comprising a second switch clutch formed as an electromagnetic switch clutch; and wherein the electric setting drive cooperates directly via the second switch clutch with the control element.

5. A load adjustment device comprising:

an accelerator pedal, a setting member which determines the output of an internal combustion engine, and a control element for acting on the setting member;

an electric setting drive, and a driver which is coupled to the accelerator pedal, the control element being moveable by means of the electric setting drive;

a desired-value detection element for detecting a position of the driver, and an actual-value detection element for detecting a position of the control element;

an electronic control device controlling the electric setting drive as a function of values detected by the desired and the actual value detection elements;

a switch clutch arranged between the driver and the control element for coupling the control element to the driver; and a free-travel element disposed at the driver, a plurality of restoring springs, and an idle emergency spring; and wherein the free-travel element cooperates with the driver side of the switch clutch;

the driver and the control element are urged in idle direction by means of the restoring springs; and the control element is urged into an idle emergency operation position by the idle emergency operation spring which acts in full-load direction.

6. A load adjustment device comprising:

an accelerator pedal, a setting member which determines the output of an internal combustion engine, and a control element for acting on the setting member;

an electric setting drive, and a driver which is coupled to the accelerator pedal, the control element being moveable by means of the electric setting drive;

a desired-value detection element for detecting a position of the driver, and an actual-value detection element for detecting a position of the control element;

an electronic control device controlling the electric setting drive as a function of values detected by the desired and the actual value detection elements;

a switch clutch arranged between the driver and the control element for coupling the control element to the driver; and at least one safety contact which is operative with either the driver or the control element for monitoring an operating position of the driver or of the control element, respectively.

7. A load adjustment device comprising:

an accelerator pedal, a setting member which determines the output of an internal combustion engine, and a control element for acting on the setting member;

an electric setting drive, and a driver which is coupled to the accelerator pedal, the control element being moveable by means of the electric setting drive;

a desired-value detection element for detecting a position of the driver, and an actual-value detection element for detecting a position of the control element;

an electronic control device controlling the electric setting drive as a function of values detected by the desired and the actual value detection elements;

a switch clutch arranged between the driver and the control element for coupling the control element to the driver; and a first safety contact and a second safety contact; and wherein the first safety contact is a driver-side safety contact which monitors the idle position of the driver; and the second safety contact is a control-element-side safety contact which monitors the idle emergency position of the control element.

* * * * *